United States Patent [19]

Van Siclen, Jr.

[11] 4,269,152

[45] May 26, 1981

[54] BREAKERLESS PULSE DISTRIBUTION SYSTEM AND OPTO-ELECTRICAL DISTRIBUTOR THEREFOR

[75] Inventor: Howard E. Van Siclen, Jr., Sidney, N.Y.

[73] Assignee: The Bendix Corporation, Southfield, Mich.

[21] Appl. No.: 908,479

[22] Filed: May 22, 1978

[51] Int. Cl.[3] ..... F02P 1/00; F02P 3/06

[52] U.S. Cl. ..... 123/146.5 A; 123/599; 123/643

[58] Field of Search ..... 123/146.5 A, 148 E, 123/32 AE, 148 CC, 148 CB

[56] References Cited

U.S. PATENT DOCUMENTS

| | | | |
|---|---|---|---|
| 3,240,198 | 3/1966 | Loudon et al. | 123/148 CC |
| 3,304,926 | 2/1967 | Maiden et al. | 123/148 E |
| 3,426,740 | 2/1969 | Hufton et al. | 123/146.5 A X |
| 3,433,208 | 3/1969 | Dogadko et al. | 123/148 CB |
| 3,463,134 | 8/1969 | Zechnall et al. | 123/146.5 A |
| 3,587,535 | 6/1971 | Kimberley | 123/146.5 A X |
| 3,587,550 | 6/1971 | Zechlin | 123/146.5 A X |
| 3,646,926 | 3/1972 | Plume, Jr. | 123/148 E |
| 3,839,659 | 10/1974 | Bruijning et al. | 123/148 E |
| 3,851,628 | 12/1974 | Ford | 123/32 AE |
| 3,851,636 | 12/1974 | Just et al. | 123/148 CC |
| 3,895,612 | 7/1975 | Keely et al. | 123/32 AE X |
| 3,931,804 | 1/1976 | Bowen | 123/148 E |
| 3,937,200 | 2/1976 | Sleder et al. | 123/148 CC |
| 3,958,543 | 5/1976 | Senda | 123/146.5 A X |
| 4,176,643 | 12/1979 | Beeghly | 123/146.5 A |

FOREIGN PATENT DOCUMENTS

| | | |
|---|---|---|
| 1031125 | 5/1966 | United Kingdom . |
| 1466937 | 3/1977 | United Kingdom . |

OTHER PUBLICATIONS

Bendix Drawing No. 10-391007.

*Primary Examiner*—Tony M. Argenbright
*Attorney, Agent, or Firm*—Richard V. Westerhoff; Raymond J. Eifler

[57] ABSTRACT

A breakerless distributor for an internal combustion engine ignition system in which a number of light emitting diodes (LEDs) (73, 75, 77, 79) equal to the number of engine cylinders are connected in series for simultaneous energization by the timing pulses. A phototransistor (83, 85, 87, 89) arranged in spaced, confronting relationship to each LED is connected to a silicon controlled rectifier (95) which triggers the energizing circuit (7, 9, 11, 13) for an individual spark plug (103) each time the phototransistor is turned on by emissions from its associated LED.

18 Claims, 4 Drawing Figures

BREAKERLESS PULSE DISTRIBUTION SYSTEM AND OPTO-ELECTRICAL DISTRIBUTOR THEREFOR

BACKGROUND OF THE INVENTION

1. Field of the Invention

This invention relates to breakerless ignition systems for internal combustion engines and to distributors therefor.

2. Prior Art

The ignition system for an internal combustion engine generates timing pulses which indicate the instant during the piston stroke that the spark plugs should be fired and distributes these pulses to the individual spark plugs to cause them to fire in a preset order. In the conventional ignition system, mechanical breakers are used to generate the timing pulses and a rotating mechanical distributor directs the pulses to the appropriate spark plugs in sequence. Since the high voltage required to fire the spark plugs greatly limited the life of the mechanical breakers, ignition systems were developed in which the switching of the high voltage necessary to fire the individual spark plugs was accomplished by breakerless electronic switches such as silicon controlled rectifiers (SCRs). This significantly improved the life of the mechanical breakers which were still used for timing pulse generation. Subsequent developments have replaced the mechanical breakers for generating timing signals with magnetic and optical pulse generators. Many of the optical timing pulse generators, however, operate with a continuous light source which requires substantial electric power and therefore limits their use with magneto equipped internal combustion engines.

Further developments have resulted in a substitute for the conventional rotating mechanical distributor in the form of a transformer distributor. In such a system, the timing pulses are applied to a rotor which induces trigger pulses in angularly distributed secondary coils to fire the appropriate SCR controlled spark generating circuit. While the transformer distributor requires little power and has a long life, it is not suitable for use in a system with small firing angles because pulses can be induced under these conditions in two adjacent secondary coils simultaneously. This possibility of double firing also limits the amount of timing pulse advance that can be utilized with a transformer distributor.

A light activated system for applying energizing pulses to the injectors of an electronic fuel injection system is disclosed in commonly owned U.S. Pat. No. 3,895,612. In this system a single, continuously illuminated radiant energy source is used to sequentially activate the fuel injectors through a fiber optic which directs the radiant energy radially outward from the center of a disc rotated in synchronism with the engine to sequentially turn on circularly arranged photodetectors associated with the fuel injector activation circuits. No means are provided for advancing or retarding the pulses thus generated.

It is a primary object of this invention to provide a novel and improved internal combustion engine breakerless ignition system with a simple, inexpensive but reliable distribution means.

It is also an object of the invention to provide such a system which can operate at small firing angles.

It is another object of the invention to provide such a system which can accept full advance of the timing signal.

It is a further object of the invention to provide such a system which requires a minimum amount of power to operate.

SUMMARY OF THE INVENTION

In accordance with the invention, a breakerless distributor for sequentially distributing electrical pulses to a plurality of electrically energizable output lines (8, 10, 12, 14) at intervals determined by pulses on a single input line (72), comprises a plurality of electrically activated radiant energy sources (73, 75, 77, 79) such as light emitting diodes (LEDs), equal in number to the number of output lines (8, 10, 12, 14), all connected in series to the input line (72) such that all the radiant energy sources (73, 75, 77, 79) are energized simultaneously for the duration of each pulse on the input line (72). A photosensitive switch (83, 85, 87, 89) arranged in spaced confronting relation to each radiant energy source (73, 75, 77, 79) is connected to complete the circuit of one of the output lines (8, 10, 12, 14) when turned on by the associated radiant energy source. A shutter member (91) arranged for movement between the radiant energy sources (73, 75, 77, 79) and the photosensitive switches (83, 85, 87, 89), blocks reception of radiant energy by all but one of the photosensitive switches at a time and is driven in synchronism with the pulses on the input line (72) to sequentially turn on one photosensitive switch after the other for each successive pulse on the input line, whereby pulses are sequentially generated on the output lines.

The spaced confronting radiant energy sources (73, 75, 77, 79) and the photosensitive switches (83, 85, 87, 89) are each arranged in a circle (121, 123) and the shutter member (91), which has a section (93) through which radiant energy may pass, is mounted for rotation between the radiant energy sources and the photosensitive switches. In a preferred embodiment of the invention, the radiant energy sources (73, 75, 77, 79) and the photosensitive switches (83, 85, 87, 89) are arranged in concentric circles (121, 123) and the shutter (91) is a cup member mounted for rotation about the common center and having a slot (93) in the wall (127) thereof through which radiant energy may pass to a preselected number, in most cases one, photosensitive switch at a time. The invention may be applied to distributing timing pulses to the spark plug energizing circuits of a gasoline engine or to the solenoids of fuel injectors in diesel engines. Where the photosensitive switches (83, 85, 87, 89) are arranged to connect the individual spark plug firing circuits (7, 9, 11, 13) or fuel injector solenoids to a common tank capacitor (25), shunting capacitors (106) may be provided across each photosensitive switch to eliminate double firing due to radio frequency interference.

Since the radiant energy source-photosensitive switch combinations operate on narrow beams of radiation, they can be placed close together to provide very small firing angles where required. They also permit the slot (93) in the cup shaped shutter (91) to be made almost as wide as the angle between adjacent photosensitive switches (83, 85, 87, 89) so that full adjustment of the timing may be accomplished without danger of double firing.

For very small or irregular firing angles, additional pairs of radiant energy sources and photosensitive switches (131–139, 133–141, 135–143, 137–145) may be arranged in additional concentric circles with an additional slotted cup (14) mounted for rotation between the additional radiant energy sources and the photosensitive switches. Separate timing pulses may be provided to simultaneously energize the additional radiant energy sources.

As an alternative to placing the radiant energy sources (73, 75, 77, 79) and photosensitive switches (83, 85, 87, 89) in concentric circles, they may be arranged in axially spaced circles. In such an arrangement, the shutter member may take the form of a slotted disc (129) mounted for rotation about the common axis.

In order to use the system with a magnetic timing pulse generator (3) at small firing angles and/or high speeds, a two step timing pulse generator has been developed. The magnetic pickup (51, 53) triggers a first gate controlled electronic switch (47) which discharges a first capacitor (31) into the gate of a second gated electronic switch (69) which in turn discharges a second capacitor (33) through the distribution LEDs (73, 75, 77, 79). While the first capacitor (31) might not recharge rapidly enough between pulses at high speed or small firing angles to turn on the LEDs (73, 75, 77, 79) due to the characteristics of the pulses from the magnetic pickup (51, 53), it will have enough charge to trigger the second gated electronic switch (69). Since the second capacitor (33) is relatively small, and the trigger pulses for the second gated electronic switch (69) are relatively short, this second switch only remains on to turn on the LEDs (73, 75, 77, 79) for a short duration thereby permitting the second capacitor to fully recharge for the next timing pulse.

DESCRIPTION OF THE PREFERRED EMBODIMENT

Figure 1:
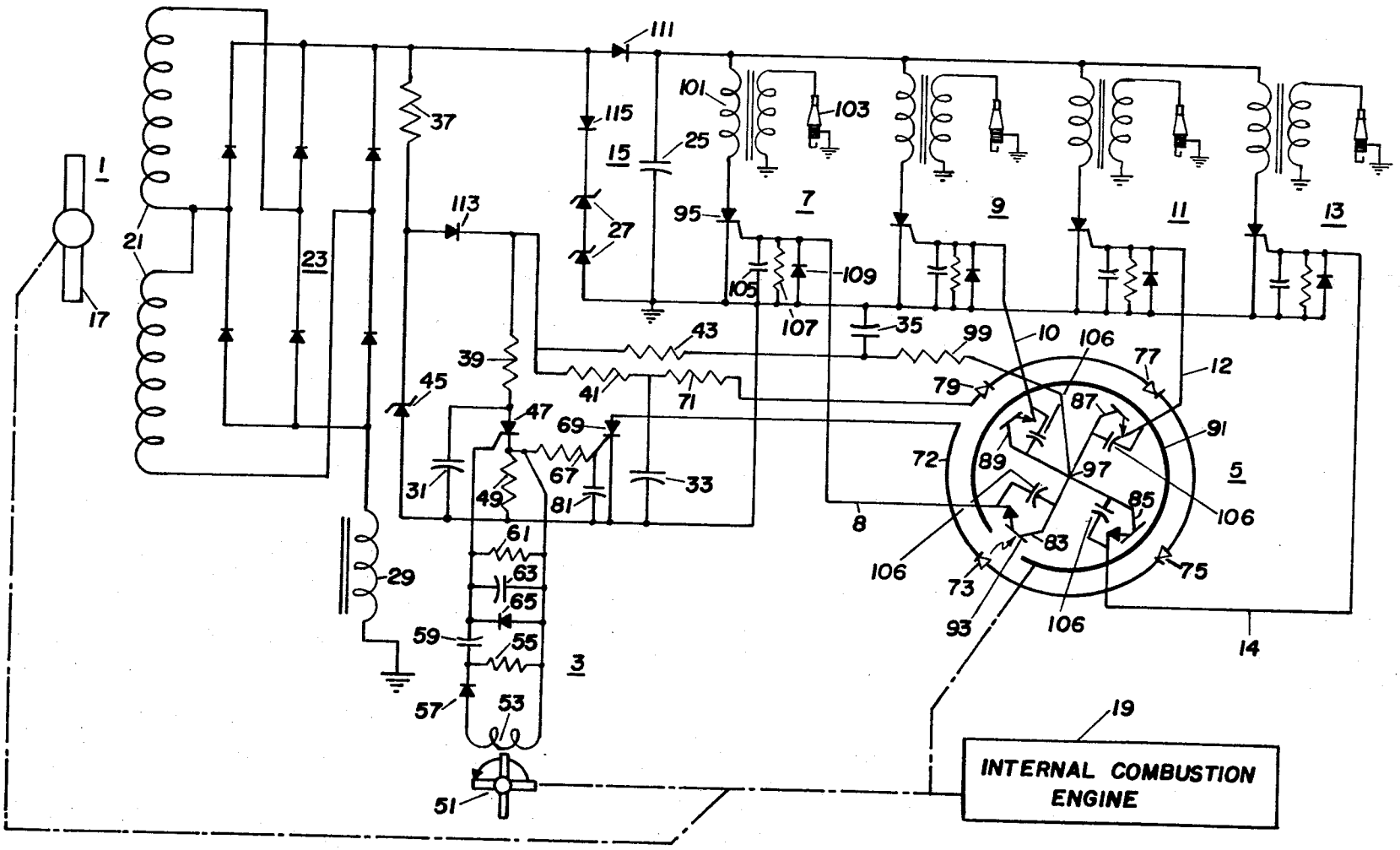
FIG. 1 is a schematic circuit diagram of a breakerless ignition system for an internal combustion engine incorporating the invention.

As illustrated in FIG. 1, the invention will be described as applied to the ignition system for a four cylinder, magneto equipped internal combustion engine, although it is to be understood that the invention is suitable for use with engines equipped with alternators or generators and with any number of cylinders. The system illustrated includes a magneto 1, a timing pulse generating circuit 3, a distributor 5, spark plug energizing circuits 7, 9, 11 and 13 (one for each cylinder of the engine), and a common pulse source 15 for the spark plug energizing circuits.

As shown symbolically in FIG. 1, the rotor 17 of magneto 1 is driven in timed relationship to the crankshaft (not shown) of the internal combustion engine 19. The alternating current induced in the coils 21 of the magneto is rectified in the full wave diode bridge circuit 23.

Direct current from the rectifier 23 charges the main tank capacitor 25 of the common pulse source 15 to a voltage determined by zener diodes 27 at a rate determined by choke 29. Capacitors 31, 33 and 35 are also charged from the bridge circuit through resistor 37 and resistor 39, 41 or 43 respectively to a voltage controlled by zener diode 45. The capacitor 31 is shunted by resistor 49 and SCR 47 which is gated by the timing pulse circuit 3. The timing circuit includes a four vane rotor 51 driven in timed relationship to the crankshaft of the internal combustion engine 19 which induces pulses in a coil 53 shunted by a load resistor 55. A diode 57 passes positive pulses through capacitor 59 to the gate of the SCR 47. Resistor 61 and diode 65 connected gate to cathode across SCR 47 protect the switch from radio frequency interference (RFI) and from destructive negative bias.

Turn on of SCR 47 by a timing pulse discharges capacitor 31 through resistor 67 into the gate of SCR 69 which fires to discharge capacitor 33 through resistor 71 and simultaneously turn on LEDs 73, 75, 77 and 79 of the distributor 5 which are series connected by line 72. A capacitor 81 protects SCR 69 from RFI. Of course, the LEDs could also be connected in parallel for simultaneous energization.

The LEDs 73, 75, 77 and 79 are arranged in spaced confronting relation with phototransistors 83, 85, 87 and 89 respectively. An annular shutter 91 driven by the crankshaft of the engine 19 rotates in the space between the LEDs and the phototransistors thereby blocking reception of light by all the phototransistors except one opposite a slot 93 in the shutter (phototransistor 83 in the Figures).

The emitter of phototransistor 83 is connected to the gate of SCR 95 in spark plug firing circuit 7 through lead 8. The emitters of phototransistors 85, 87 and 89 are connected by leads 14, 12 and 10 to the gates of SCRs in similar spark plug firing circuits 13, 11 and 9 respectively. The collectors of the phototransistors are connected through a common junction 97 and resistor 99 to capacitor 35 which supplies the common firing pulse for the SCRs 95. The SCR 95 when turned on by the phototransistor discharges the main tank capacitor 25 through the primary of ignition coil 101 to generate the high voltage required to fire the spark plug 103 connected to the secondary of the ignition coil. The spark plug in the other spark plug firing circuits 9, 11 and 13, are fired in a similar manner when their associated phototransistors are turned on.

The SCRs 95 of the firing circuits are each protected from RFI and excessive negative bias by a capacitor 105, a resistor 107 and a diode 109. Protection is also provided against RFI turn on of the nonselected phototransistors by shunting each one with a capacitor 106. Diodes 111 and 113 prevent bleed off of the charges on capacitors 25 and 31, 33 and 35 respectively and the diode 115 blocks current from shunting through zener diodes 27 during operation of the ignition circuits as described below.

Figure 2:
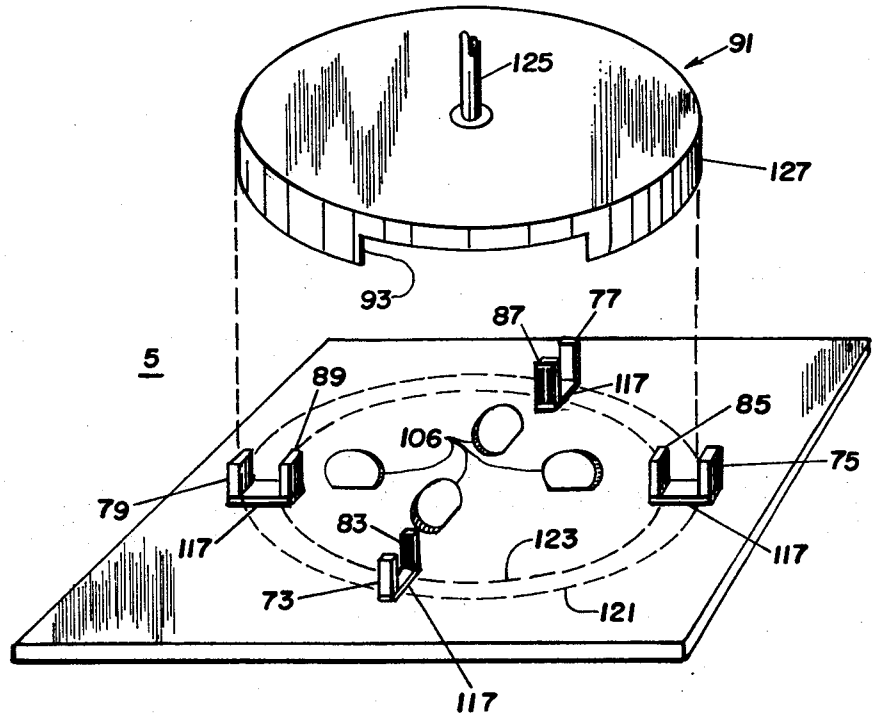
FIG. 2 is an isometric exploded view of a distributor according to the invention showing the physical relationship of part of the system shown in FIG. 1.

The physical arrangement of the principal components of the distributor 5 are illustrated in the exploded view of FIG. 2. The LEDs 73, 75, 77 and 79 and the corresponding phototransistors 83, 85, 87 and 89 are mounted in spaced confronting relation on mounts 117 which in turn are secured on a printed circuit board 119 with the LEDs and phototransistors arranged in concentric circles 121 and 123 respectively. The shutter 91 is in the form of a cup mounted for rotation on an engine driven shaft 125. The cup, which is shown in a raised position in FIG. 2 for clarity, rotates about the common center of the LED phototransistor array with wall 127 passing through the gaps between the LEDs and phototransistors. The cup wall 127 is opaque and therefore blocks reception of light by a phototransistor from its associated LED. However, when a slot 91 (or a transparent section) in the cup wall is adjacent an LED-phototransistor pair, energization of the LED by a timing pulse will turn on the phototransistor. Since the slot is only wide enough to uncover one LED-phototransistor pair at a time, only one phototransistor can be turned on for each timing pulse despite the fact that all of the LEDs are energized simultaneously.

The rotation of the cup 91 and the generation of timing pulses are coordinated with the rotation of the crankshaft of the engine such that successive phototransistors are sequentially turned on by successive timing pulses. As seen in FIG. 2, the shunting capacitors 106 can be mounted on the printed circuit board adjacent the phototransistors. Other components of the circuit of FIG. 1 may be mounted on the underside of the printed circuit board 119.

Adjacent LED-phototransistor pairs are angularly spaced at intervals equal to the firing angle of the engine. Since the light emitted by the LEDs can be directed in narrow beams, the LED-phototransistor pairs can be positioned in close proximity to one another and can therefore be used in distribution systems for engines having large numbers of cylinders with very small firing angles. In addition, the narrow angular sensitivity of the LED-phototransistor pairs assures that each phototransistor only responds to light emitted by its associated LED and therefore the cup 91 is only required to screen the nonselected phototransistors from their own LEDs. Thus, the slot 93 in the cup wall 127 can be nearly as wide angularly as the firing angle without causing double firing of spark plugs. Since the wide slot exposes the phototransistor to a pulse of light from its associated LED for an interval which substantially exceeds the duration of a timing pulse, full advance of the timing pulses can be accommodated by the distributor. Advance of the timing pulses can be effected by mechanical or electronic means.

Operation of the disclosed ignition system can be summarized as follows. Assume that capacitors 25, 31, 33 and 35 are all charged and that a timing pulse is generated by the rotor 51 when the slot 93 in the cup member 91 is aligned with phototransistor 83 as shown in the drawings. The timing pulse fires SCR 47 which discharges capacitor 31 into the gate of SCR 69. Firing of SCR 69 discharges capacitor 33 to turn on all of the series connected LEDs 73, 75, 77 and 79 simultaneously. The light emitted by LED 73 turns on phototransistor 83 which discharges capacitor 35 into the gate of SCR 95 in firing circuit 7. The firing of SCR 95 discharges the main tank capacitor 25 through the primary of ignition coil 101 and fires the spark plug 103 connected to the ignition coil secondary winding. With the bridge 23 alone connected across the capacitor 25, the tank circuit formed by this capacitor and the primary of the ignition coil would not ring to turn off SCR 95. However, the choke 29 drops the potential of the bridge 23 below ground so that the voltage across capacitor 25 can swing negative to cut off the SCR 95 holding current and allow capacitor 25 to recharge rapidly for the next firing pulse. The diode 115 prevents current from shunting through zeners 27 which would clamps capacitor 25 at about one 1½ volts negative.

The other capacitors are recharged as follows. Since capacitor 33 is small and the trigger pulse applied to SCR 69 is short in duration, this switch turns off after a short interval to allow capacitor 33 to recharge. With the LEDs' current terminated, phototransistor 83 turns off to allow capacitor 35 to recharge. Capacitor 31 is recharged when the pulse applied to the gate of SCR 47 drops below the threshold voltage. While, due to the characteristics of the pulses generated by the magnetic pickup, this may not occur early enough at high speeds or small firing angles to permit capacitor 31 to charge to a voltage sufficient to turn on the LEDs, capacitor 31 will always attain the voltage required to turn on SCR 69.

With the capacitors recharged and the cup member 91 rotated counterclockwise in FIG. 1 by the engine, slot 93 will be aligned between LED 75 and phototransistor 85 when the next timing pulse is generated. This results in firing of the spark plug in plug energizing circuit 13 in a manner which is clear from the description above. Subsequently, pulses from the timing circuit will be distributed to firing circuits 11 and 9 and so on.

Figure 4:
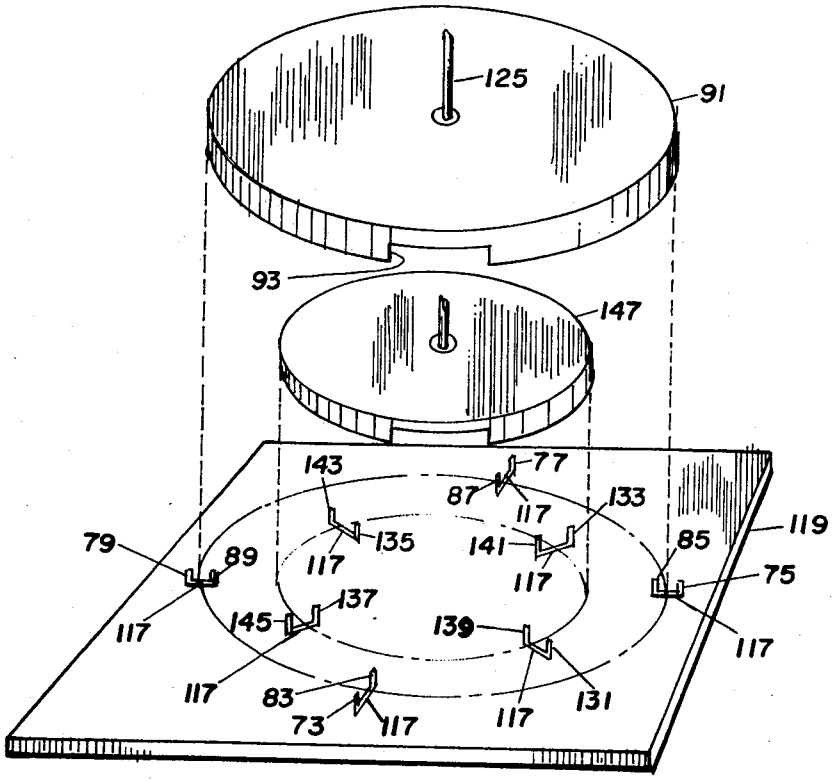
FIG. 4 is an isometric exploded view of a modification of the distributor shown in FIG. 2.
Figure 3:
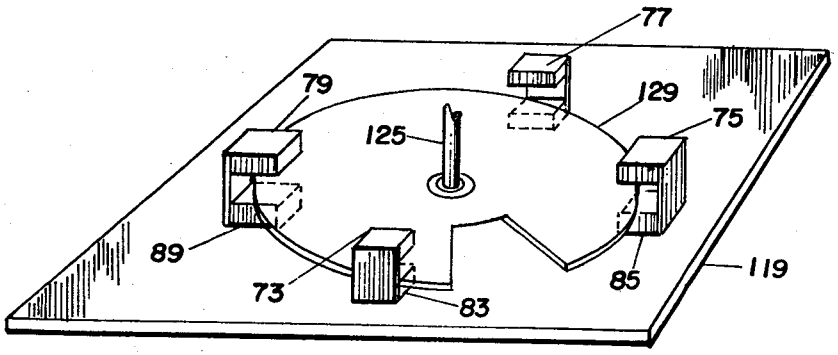
FIG. 3 is an isometric view of another embodiment of the invention.

While one specific embodiment of the invention has been described in detail, numerous modifications fully within the spirit of the invention can be made by those skilled in the art. For instance, while the LEDs and phototransistors are arranged in concentric circles in the preferred embodiment of the invention, they can alternatively be arranged in axially spaced circles of equal diameter with a flat, slotted disc 129 disposed between them as a shutter as illustrated in FIG. 3. It can also be appreciated that more than one LED-phototransistor pair can be exposed by the shutter at one time in applications where multiple firing signals are required, such as in engines with a large number of cylinders. It is also possible, due to the narrow directional sensitivity of the devices, to arrange two rows or concentric circles of LEDs and phototransistors with each row controlled by its own trigger signals but with LED-phototransistor pairs from each row uncovered by a slot in the shutter in its row or concentric circle. For example, as shown in the exploded view of FIG. 4, additional LED-phototransistor pairs 131–139, 133–141, 135–143 and 137–145 may be arranged in concentric circles inside (or outside) the concentric circles formed by the LED-phototransistor pairs 73–83, 75–85, 77–87 and 79–89. The additional LEDs 131, 133, 135 and 137 are simultaneously energized by their own trigger signal. An additional slotted cup 147 also driven in synchronism with the engine crankshaft, allows only one of the additional phototransistors at a time to be turned on in the manner previously described. This arrangement is suitable for systems having staggered firing angles or firing angles smaller than can be physically accommodated by a single row of LED-phototransistor pairs as, for instance, systems having twenty or more spark plugs to be fired. The invention may also be applied to diesel engines wherein the timing pulses would be distributed to the solenoids of the fuel injectors rather than to spark plugs. Many other modifications to the invention could be made by those skilled in the art and therefore the scope of the invention is to be limited only by the appended claims.

I claim as my invention:

1. A breakerless distributor for sequentially distributing electrical pulses to a plurality of electrically energizable output lines at intervals determined by pulses on a single input line, said distributor comprising:

a plurality of electrically activated radiant energy sources, equal in number to the number of output lines, all connected to the input line to emit radiant energy simultaneously for the duration of each pulse on said input line;

a photosensitive switch associated with each radiant energy source and arranged in confronting spaced relation thereto, each of said photosensitive switches being connected in an output line to complete the circuit thereof when turned on by the associated radiant energy source;

a shutter member arranged for movement between said radiant energy sources and said photosensitive switches for blocking the reception of radiant energy from the associated radiant energy source by all but one of the photosensitive switches at a time; and means for moving the shutter member relative to the radiant energy sources and the photosensitive switches in synchronism with the pulses on the input line to sequentially and repetitively unblock the reception of radiant energy by each photosensitive switch in order for each successive pulse on the input line for an interval which exceeds the duration of a timing pulse whereby pulses are sequentially generated on successive output lines and adjustments in the timing pulses can be accommodated.

2. The distributor of claim 1 wherein said spaced confronting radiant energy sources and said photosensitive switches are each arranged in a circle and wherein said shutter member is mounted for rotational movement between the radiant energy sources and the photosensitive switches, and is provided with a section through which radiant energy may pass, said section being angularly wider than needed to turn on one photosensitive switch with a timing pulse but narrower than needed to turn on two adjacent photosensitive switches simultaneously.

3. The distributor of claim 2 wherein said spaced confronting radiant energy sources and said photosensitive switches are arranged in concentric circles and wherein said shutter member is an annular member mounted with its rotational axis coincident with the centers of said concentric circles and having a slot therein through which radiant energy may pass to turn on the photosensitive switch adjacent said slot, said slot being wider than the gap needed to turn on one photosensitive switch but narrower than that needed to turn on two photosensitive switches simultaneously.

4. The distributor of claim 2 wherein said spaced confronting radiant energy sources and said photosensitive switches are arranged in axially spaced circles and wherein said shutter member is a disc mounted for rotation about the common axis and having a slot therein through which radiant energy may pass to turn on the photosensitive switch adjacent said slot, said slot being wider than the gap needed to turn on one photosensitive switch but narrower than that needed to turn on two photosensitive switches simultaneously.

5. A breakerless distributor for distributing timing pulses to an energizing circuit associated with each cylinder of a multi-cylinder internal combustion engine, said distributor comprising:

a plurality of light emitting diodes, equal in number to the number of cylinders, arranged in a circle and all connected for simultaneous energization by each timing pulse;

a photodetector associated with each light emitting diode and arranged in spaced confronting relation thereto, each of said photodetectors being connected to supply a pulse to one of said energizing circuits when turned on by its associated light emitting diode; and a rotatable member mounted for rotation between the light emitting diodes and the photodetectors for blocking the reception of light from the associated light emitting diode by all but a preselected number of said photodetectors at a time, and for sequentially unblocking the preselected number of photodetectors for an interval which exceeds the duration of said timing pulses as the rotatable member is driven by said engine, whereby the distributor may accommodate adjustments in the timing of said timing pulses.

6. The distributor of claim 5 wherein said preselected number of photodetectors is one.

7. The distributor of claim 6 wherein each photodetector, in addition to being individually connected to one of the energizing circuits, is also connected to a junction common to all the photodetectors, said combination including a separate shunting capacitor connected across each photodetector.

8. The distributor of claim 6 wherein said photodetectors are arranged in a circle which is concentric with the circle formed by the light emitting diodes and wherein said rotatable member is a cup shaped member mounted for rotation about the common center of the light emitting diode and photodetector arrangement with the wall of said cup rotatable between said light emitting diodes and photodetectors and having a slot therein through which said one photodetector at a time may receive light from its associated light emitting diode, said slot being angularly wider than the gap needed to turn on a photodetector but angularly narrower than the gap needed to turn on two adjacent photodetectors simultaneously.

9. The distributor of claim 8 including additional light emitting diodes and photodetector pairs arranged in additional concentric circles which are concentric with said light emitting diode photodetector arrangement, means for providing trigger pulses to simultaneously energize said additional light emitting diodes and a second cup member mounted for rotation about said common center with the wall of said second cup rotatable between said additional light emitting diodes and photodetectors and having a slot through which one additional photodetector at a time may receive light from its associated light emitting diode, said slot in the second cup member being angularly wider than the gap needed to turn on one additional photodetector but angularly narrower than the gap needed to turn on two adjacent additional photodetectors simultaneously.

10. The distributor of claim 6 wherein said photodetectors are arranged in a circle axially spaced from the circle formed by said light emitting diodes and wherein said rotatable member is a disc mounted for rotation about the common axis of the light emitting diode and photodetector arrangement between the light emitting diodes and photodetectors and having a slot therein through said one photodetector at a time may receive light from its associated light emitting diode, said slot being angularly wider than the gap needed to turn on a photodetector but angularly narrower than the gap needed to turn on two adjacent photodetectors simultaneously.

11. The distributor of claim 6 wherein said energizing circuit associated with each cylinder is a spark plug energizing circuit and wherein the pulses generated by said photodetectors are applied to the spark plug energizing circuits.

12. The distributor of claim 6 wherein said energizing circuit associated with each cylinder is a fuel injector energizing circuit and wherein the pulses generated by said photodetectors are applied to the fuel injector energizing circuits.

13. In a breakerless electrical ignition system for the spark plugs of a multi-cylinder internal combustion engine:

timing means for generating electrical timing pulses in synchronism with the rotation of the engine crankshaft;

means associated with each spark plug for supplying a high energy firing pulse thereto and including an electrical switch for triggering the same; and distributor means for sequentially triggering said electronic switches to fire said spark plugs in order, said distributor comprising:

a plurality of electrically activated radiant energy sources, equal in number of the number of spark plugs, arranged in a circle and all connected to the timing means for simultaneous energization for the duration of each timing pulse, a photosensitive switch associated with each radiant energy source and arranged in spaced confronting relationship thereof, each of said photosensitive switches being connected to one of said electronic switches for triggering the same when radiant energy is received from the associated radiant energy source;

a rotatable member mounted for rotational movement between the radiant energy sources and the associated photosensitive switches for blocking the reception of radiant energy from the associated radiant energy source by all but a preselected number of the photosensitive switches, and means connected to the crankshaft of the engine for rotating said rotatable member to sequentially unblock the reception of radiant energy by the photosensitive switches for intervals exceeding the duration of a timing pulse and thereby trigger the electronic switches and fire the spark plugs in order at intervals determined by the timing pulses despite adjustments in timing of the timing pulses.

14. The system of claim 13 wherein the radiant energy sources are LEDs.

15. The system of claim 14 wherein said preselected number of photosensitive switches is one.

16. The system of claim 15 wherein said rotatable means includes a sector through which the radiant energy may pass to the associated photosensitive switch, said sector being angularly wider than the beam of light emitted by the LED but only wide enough to allow light to pass to one photosensitive switch at a time.

17. The ignition system of claim 15 wherein said photosensitive switches are phototransistors and said electronic switches are SCRs and including a common capacitor connected through the individual phototransistors to the gates of each of the SCRs to trigger the same in response to energization of the associated phototransistor by its associated LED, means for recharging said common capacitor between discharges into the SCR gates, and shunting capacitors connected individually across each of said phototransistors to suppress radio frequency interference and prevent triggering the SCRs other than the one connected to the one phototransistor that is turned on at a time.

18. The ignition system of either claim 15 or claim 17 wherein said timing means comprises:

a magnetic pickup for generating trigger pulses at intervals determined by an engine driven vane member; and a two stage driver circuit including first and second capacitors, first and second gated electronic switches and means for recharging said capacitors, said first gated electronic switch being connected across the first capacitor to discharge the same into the gate of the second gated electronic switch when triggered by a trigger pulse from the magnetic pickup, said second gated electronic switch being connected in series with the LEDs across the second capacitor for discharging the same through the LEDs to turn them all on simultaneously when gated by discharge of the first capacitor, and said second capacitor being recharged by the recharging means when the current through the second gated electronic switch drops below its holding voltage as the second capacitor discharges through the LEDs and said first capacitor being recharged by the recharging means when the voltage of the trigger pulse drops below the threshold voltage of the first electronic switch.

* * * * *